United States Patent [19]

Schramayr et al.

[11] Patent Number: 5,029,537

[45] Date of Patent: Jul. 9, 1991

[54] METHOD AND APPARATUS FOR CONTOURED FOLDING AND HEMMING OF FABRIC PARTS, SUCH AS POCKET PLIES

[76] Inventors: Ernst Schramayr, P.O. Box 326, Barneveld, N.Y. 13304; Tadeusz A. Olewicz, 415 Deland Dr., Utica, N.Y. 13501; Robert J. Beasock, 7472 Coleman Mills Rd., Rome, N.Y. 13440

[21] Appl. No.: 365,925

[22] Filed: Jun. 14, 1989

[51] Int. Cl.[5] ..... D05B 19/00; D05B 21/00

[52] U.S. Cl. ..... 112/121.11; 112/121.12; 112/113; 112/147

[58] Field of Search ..... 112/113, 114, 121.11, 112/121.12, 121.15, 141, 144, 147, 148, 303, 311, 262.1, 262.3; 271/229

[56] References Cited

U.S. PATENT DOCUMENTS

| | | | |
|---|---|---|---|
| 3,420,515 | 1/1969 | Off et al. | 112/121.11 X |
| 3,667,411 | 6/1972 | Perlino | 112/121.12 |
| 3,773,002 | 11/1973 | Burton | 112/121.12 |
| 4,068,603 | 1/1978 | Arbter | 112/121.11 |
| 4,095,538 | 6/1978 | Rockerath et al. | 112/147 |
| 4,287,841 | 9/1981 | Rovin | 112/121.11 |
| 4,464,160 | 8/1984 | Joyce | 112/147 X |
| 4,517,907 | 5/1985 | Franke, Sr. | 112/147 X |
| 4,562,782 | 1/1986 | Doucette et al. | 112/147 X |
| 4,711,188 | 12/1987 | Yoneda | 112/113 X |
| 4,768,451 | 9/1988 | Spencer, III | 112/121.12 |

FOREIGN PATENT DOCUMENTS

| | | | |
|---|---|---|---|
| 1460153 | 6/1963 | Fed. Rep. of Germany | 112/121.11 |
| 46623 | 11/1984 | Japan | 112/147 |

*Primary Examiner*—Werner H. Schroeder
*Assistant Examiner*—Paul C. Lewis

[57] ABSTRACT

Method and apparatus is disclosed for the automated forming and hemming of pocket plies or like parts provided with a contoured top flap. Individual pocket plies are picked from a stack and positioned on a plate provided with V-contoured forward end edge. A clamping die clamps the ply to the plate and conforms a projecting hem-forming margin to the V-contoured (or other shaped) forward edge. A transfer mechanism completes the hem fold and, by the use of a transfer clamp, engages the folded hem area. After the clamping die is opened, the transfer clamp removes the ply and conveys it to a sewing station, while forming the top fold of the pocket ply. The top fold is completed as the transfer mechanism places the ply on the surface of the sewing table and transfers it to the control of a controllably movable sewing clamp. After retraction of the transfer mechanism, the movable sewing clamp advances the folded ply relative to a sewing needle, for sewing of the folded, V-contoured hem to the body of the pocket ply, simultaneously completing the hem and the "V" pocket flap. Special clamping devices enable the pocket ply to be gripped by one clamp before being released by the other to maintain positive control over the part.

24 Claims, 4 Drawing Sheets

METHOD AND APPARATUS FOR CONTOURED FOLDING AND HEMMING OF FABRIC PARTS, SUCH AS POCKET PLIES

BACKGROUND AND SUMMARY OF THE INVENTION

In the production of dress shirts and the like, for example, having front pockets formed thereon, it is conventional practice to partially pre-process the parts such that, at the time of placement on and sewing to the shirt front, the part already has the top flap and hem formed thereon and presewn. In this connection, the ply of fabric, sometimes referred to as the pocket part, which is sewn to the shirt front to form the pocket, typically is provided with a folded-over top flap, which is hemmed and sewn across the front of the pocket part to reinforce the upper portion of the pocket. It is frequently desirable to form the top flap of the pocket part in a "V"-shaped contour.

In the automated preprocessing of pocket parts and the like, equipment is known and available for picking parts one at a time from a supply stack and delivering such parts to folding and sewing stations, for pre-forming of the top fold. In general, however, such automated preprocessing equipment is limited to the forming of straight-across hems at the lower edge of the top flap of the pocket, because of the inherent complications involved in both the folding and the sewing of a top flap formed with a shallow V-shaped or otherwise contoured hem. Heretofore, the forming of pockets with V-contoured top flap configuration has relied principally on hand operations, adding significantly to the cost of manufacture.

SUMMARY OF THE INVENTION

In accordance with the present invention, a novel and improved method and apparatus is provided for fully automating the preprocessing of pocket parts and similar components to form contoured, hemmed flaps thereon. The procedure and apparatus of the invention involves placement of the pocket ply, for example, on a shutter plate member having an edge formed with the desired "V" or other contour. Initially, the pocket ply is controllably positioned on the contoured plate, with a hem-forming margin projecting beyond the contoured edge. A controlled, contoured hem fold is made by means of a clamping die having a shallow L-shaped cross sectional configuration such that part of the die presses downward on the upper surface of the plate, to clamp the ply, and a second portion of the die confronts and conforms to the contoured end edge of the plate, forcing the ply to fold downwardly, over the edge of the shutter plate, in a tightly conformed contoured configuration. Forming of the hem fold is then completed by the projection, under the before-described plate member, of a folding plate means, which engages the downwardly projecting remaining portion of the hem fold margin, and folds that margin horizontally underneath the contoured plate member to form a contoured hem.

In the apparatus of the invention, novel and improved arrangements are provided for effecting transfer of the hem-folded but unsewn pocket part from the hem folding station to a remote sewing station without losing control over the folded hem. In part, this involves the use of separate, complimentary ply clamping means at the folding station and on the transfer means. This arrangement enables the transfer mechanism to clamp and control the hem-folded fabric ply prior to its being released by the hem-forming clamp means, so that the folded ply is at all times under positive control. In one advantageous embodiment, each clamp is comprised of forwardly opening recesses and intervening and adjacent projections, with the recesses of one clamp member being complimentary to the projections of the corresponding clamping member on the other station. The complimentary clamps may also be arranged to grip narrow margins of the hem fold without interleaving.

In a similar manner, complimentary clamp means are provided at the sewing station, enabling the hem-folded pocket part to be engaged and secured by a clamp at the sewing station prior to being released by the transfer clamping means. As a result, the hem-folded part is maintained under positive control throughout, from the time of forming of the hem until it is actually sewed on the sewing table.

Advantageously, the apparatus of the invention includes projectable and retractable folding plate means associated with the transfer mechanism. Most desirably, the folding plate means includes first and second folding plates, one located directly above the other, and independently projectable and retractable. After the hem is conformed to the edge of the shutter plate member, the first folding plate is projected underneath the plate member to complete the folding of the hem margin. Thereafter, the second folding plate is projected forward, underneath the first, providing a straight-across edge that defines the location of the top fold of the pocket ply. Thus, upon separation of the hem-folded ply from the shutter plate member, the body of the ply drapes downward over the edge of the second folding plate, thereby partially forming of the top fold of the pocket ply.

Completion of the top fold, with the method and apparatus of the invention, is advantageously brought about by manipulation of the transfer means in the course of carrying the hem-folded pocket part from the hem folding station to the sewing station. By projecting the transfer clamp and folding plates forwardly over the front edge of the sewing table, the draped portion of the pocket ply is caused to be folded up under the second folding plate, to complete the folding of the top flap of the pocket ply. Once this final fold has been completed, clamping of the folded part is transferred from the transfer clamp to the sewing clamp, maintaining positive clamping control at all times. Thereafter, the folding plate means are withdrawn, leaving only the folded pocket ply pressed to the sewing table by the sewing clamp and ready for sewing. Sewing of the hem and top folds is accomplished by programmed (e.g., mechanical or electronic) manipulation of the sewing clamp, to convey the V-contoured hem fold past the sewing needle.

Desirably, when retracting the folding plate means, the second folding plate is withdrawn first, enabling that plate, with its longer forward projection, to be completely withdrawn without in any way affecting the hem fold. Thereafter, the first or hem folding plate is retracted, with minimum opportunity for dislocation of the hem fold.

For a more complete understanding of the above and other features and advantages of the invention, reference should be made to the following detailed description of a preferred embodiment, and to the accompanying drawings.

DESCRIPTION OF A PREFERRED EMBODIMENT

Figures 1, 1A, 1B:
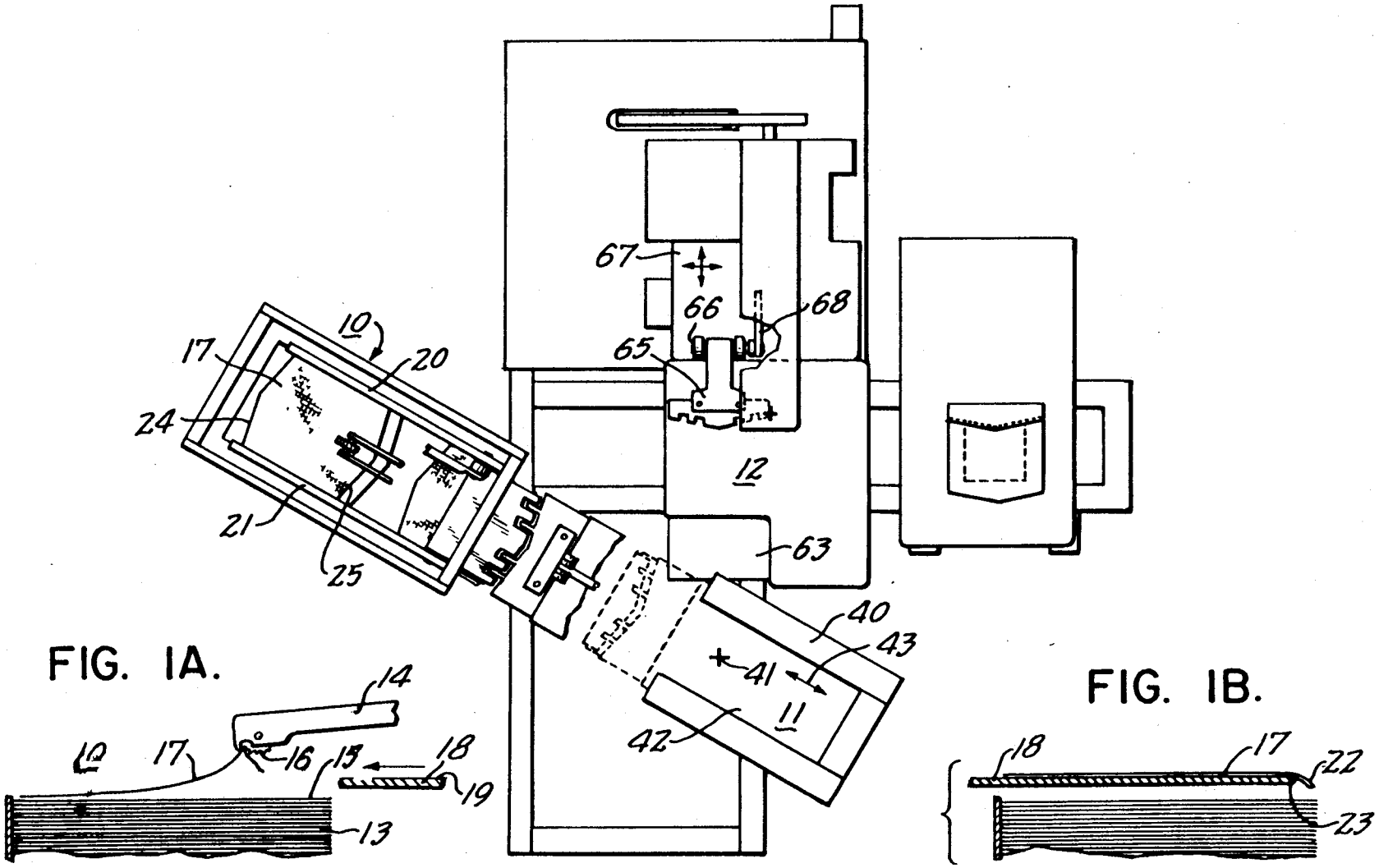
FIG. 1 is a highly simplified, schematic top plan view of an apparatus according to the invention for forming and sewing a V-contoured pocket top flap in a pocket ply on a fully automated basis.
FIG. 1*a* is a schematic illustration of a ply picker device, advantageously used in the apparatus of FIG. 1, for removing one ply at a time from the stack for placement on a plate-like shutter member for performing various hem folding operations.
FIG. 1*b* is a view, similar to FIG. 1*a*, showing a separated ply after deposit on the plate-like member.

Referring now to the drawing, the reference numeral 10 designates generally a supply means for supplying pocket plies, one at a time, for preprocessing according to the invention to effect folding and sewing of a V-contoured pocket flap. The reference numeral 11 designates in a general way a transfer means, for transferring a partly processed pocket ply to a sewing station, generally designated by the reference numeral 12.

Advantageously, the supply station 10 comprises in large part a mechanism known as a "Ply Picker", as made available commercially by Cluett, Peabody & Co., Inc., New York, N.Y. General principles of the ply picker apparatus are illustrated and described in U.S. Pat. No. Re. 30,084, reissued Aug. 28, 1979 and assigned to Cluett, Peabody & Co., Inc. The disclosure of such patent are incorporated herein by reference.

For the purposes of the present description, it is sufficient to note that the supply station 10 for pocket plies includes a stack 13 containing a large number of plies stacked vertically, one upon the other. A picker arm 14 is mounted above the stack and is adapted to be periodically pivoted to bring its outer end down upon the stack 13, adjacent one end 15. The outer end of the picker arm incorporates a controllably rotatable, toothed wheel 16, which is brought into contact with the top ply of the stack and then rotated to cause the first ply 17 of the stack to be "pinched" and thereby gripped by the wheel, after which the picker arm 14 is pivoted upward, to the position shown in FIG. 1*a* of the drawing. A plate-like member 18, functioning as a transfer shutter, is then projected over the top of the stack 13, but underneath the partially lifted ply 17 engaged by the picker arm, causing the ply 17 to be fully separated from the stack and rested upon the upper surface of the plate member 18. The toothed wheel 16 is then reversed, releasing the ply 17 and causing it to be dropped upon and supported by the upper surface 19 of the plate.

In the apparatus of the invention, guide rails 20, 21 are positioned at opposite sides of the stack 13 and along the motion path of the shutter plate 18. One of the guide rails is controllably movable toward and away from the other and is used to position the side edges of the ply 17 and properly orient the ply when it is deposited on the shutter plate and as it travels with the plate.

As shown in FIG. 1*b*, when the pocket ply 17 is initially deposited on the shutter plate 18, a portion 22 of the ply overhangs the forward edge 23 of the plate. Because the initial depositing of the ply 17 on the shutter plate 18 is not readily carried out with a high degree of precision as to the front-to-back positioning of the ply on the plate, the initial deposit of the ply is such that a modest but controllable excess of material is included in the overhang 22 so that, within the tolerances of the initial deposit positioning, there will always be at least enough material in the overhang to form a hem fold at the edge of the plate.

As is reflected in FIG. 1, pre-cut pocket plies, for shirt pockets with V-contoured flaps are frequently cut with a V-contour at both ends, but the bottom contour is not material to this invention. As the plies are oriented in FIG. 1, the edge of the ply 17 toward the left will be the bottom of the pocket in the final assembly, while the V-contoured edge 25 at the right hand side will be used in forming the hemmed V-contoured top flap.

Figure 2A:
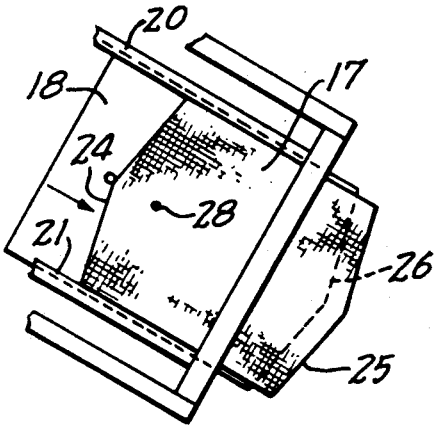
FIG. 2*a* is a fragmentary top plan view of the separated pocket ply in the process of being delivered to the hem-folding station.
Figure 2B:
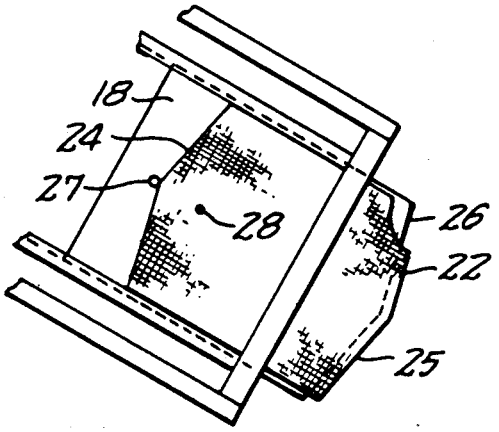
FIG. 2*b* is a view, similar to FIG. 2*a*, illustrating the pocket ply after controlled positioning thereof on the delivery plate, ready for the hem folding operation to proceed.

As reflected particularly in FIGS. 1, 2*a* and 2*b*, the forward edge 26 of the shutter plate 18 is formed with a shallow V-contour corresponding to the V-contour to be formed in the folded pocket ply. Ideally, the forward edge 25 of the pocket ply should have an identical contour with the leading edge 26 of the shutter plate, in order to provide a uniform hem fold across the face of the pocket ply.

Following the initial deposit of the ply 17 on the shutter plate 18, with at least a minimum excess of overhang 22, the shutter 18 is moved from its load position, shown in FIG. 1*b*, to its delivery position, shown in FIG. 2*b*.

In the course of the shutter plate's transit from the load position to the delivery position, means are provided for precisely adjusting the position of the pocket ply on the shutter, so that the final amount of overhang 22 is, within close tolerances, the amount desired for the hem-folding operation. The means provided for this purpose are otherwise known and not part of this invention and include a photoelectric detector means schematically indicated in FIGS. 2*a* and 2*b* at 27, and a solenoid actuated stop finger device, schematically indicated in FIGS. 2*a*, 2*b*, at 28. A particularly desirable system for this purpose is described in the copending application of Robert J. Beasock, et al. Ser. No. 228,380, filed Aug. 4, 1988, now U.S. Pat. No. 4,865,309, granted Sep. 12, 1989. In the simplified arrangement illustrated, the passage of the trailing edge 24 of the pocket ply 17 past the photocell beam is registered by the change in reflection level from the now-exposed shutter plate 18. This causes instantaneous actuation of the solenoid actuated stop plunger 28, causing a stop element to be projected into engagement with the fabric ply. The arrangement is such that further forward movement of the fabric ply is prevented, while the shutter plate 18 continues to move slidingly underneath it until it reaches its normal limit position, shown in FIG. 2. Operation of the shutter plate 18 may be any suitable means, such as a fluid cylinder, for example (not shown), which provides a consistent, fixed delivery position limit for the shutter. Accordingly, with the fabric ply stopped in a consistently fixed position by the plunger 28 and the shutter 18 having a fixed limit position by means of its actuating system, there will be a consistent, accurately predetermined hem-forming margin overhang 22 of the ply, when the shutter is in its delivery position, as shown in FIG. 2*b*.

Pursuant to the invention, when the shutter and ply are in the delivery position, a clamping die 29, normally poised above the delivery position of the shutter plate 18, is actuated to descend upon the shutter plate 18 and engage the pocket ply 17 positioned thereon. Desirably, the clamping die 29 is pivotally mounted at 30 to frame structure above the delivery position of the shutter, and is typically actuated by a fluid cylinder, partially shown at 31 in FIG. 3, connected to a lever arm 32 extending upward from the clamping guide.

According to the invention, the clamping guide 29 has a downwardly facing recess, which is contoured to conform closely to the V-shaped contours of the forward edge 26 of the shutter plate. To this end, the clamping die has a downwardly facing surface 33 arranged, when the clamp is actuated, to be parallel to the upper surface of the shutter plate 18 and sufficiently close thereto to press downward upon a pocket ply supported thereon. The forward edge of the recess is defined by a V-contoured vertical surface 34 positioned approximately one fabric thickness forward of the forward edge 26 of the shutter plate, sufficient to allow for the presence of the fabric margin 22, while forcing said margin into a downwardly projected orientation, tightly conforming to the front edge of the shutter plate. Thus, when the clamping die 29 is actuated to its operative position, shown in FIG. 4, the first phase of the V-contoured hem fold is accomplished.

The transfer mechanism 11, which is positioned in front of the loading station 10, includes a base 40 mounted for controlled pivoting movement about a vertical axis 41. The base 40 mounts a transfer slide 42 arranged for controlled linear movement in the direction of the axis 43 by means of a fluid actuated cylinder or the like (not shown).

Mounted at the forward end of the transfer slide 42 is a first folding plate 44, which is preferably fixed to the slide and movable therewith. Also mounted on the slide 42 is a transfer clamp 45, pivotally mounted at 46 and arranged for opening and closing movements by means of a fluid actuator or the like, partially indicated at 47.

Figure 3:
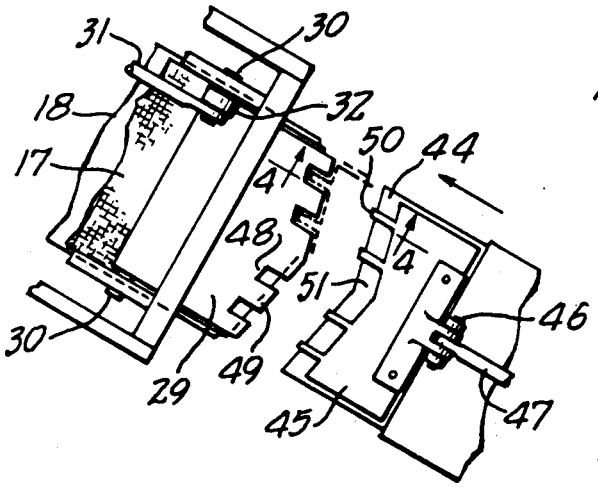
FIG. 3 is a fragmentary top plan view of the apparatus, with the ply and plate in the positions of FIG. 2*b*, and illustrating a die clamp and transfer clamp.

In the illustrated arrangement, as shown in FIG. 3, for example, the clamping die 29 is provided along its forward edge with a plurality of spaced apart, forwardly opening recesses 48 with projections 49 between and adjacent each of the recesses. The transfer clamp 45 is provided with a plurality of projections 50 and intervening spaces 51, which are complimentary to the respective spaces 48 and projections 49 of the clamping die. The arrangement is such that, when the transfer slide 42 is projected forwardly to a forward limit position, the projections 50 of the transfer clamp are received within the recesses 48 of the clamping die 29. This enables the transfer clamp to be closed upon the fabric ply simultaneously with the clamping die 29, with both clamping elements having positive control over the ply.

As reflected in FIG. 3, the frontal contours of the transfer clamp 45 are in the form of a shallow "V" closely complimentary to the V-contours of the clamping die 29. The first folding plate 44 directly underlies the projections 50 of the transfer clamp and is preferably, although not necessarily, of a V-contour similar to that of the clamp.

Figure 4:
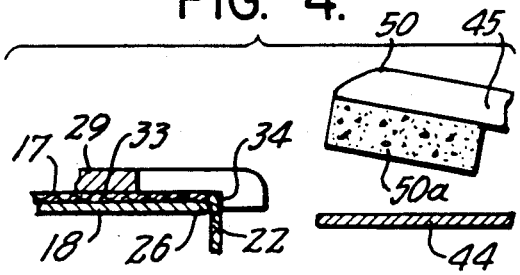
FIGS. 4 and 5 are sequential views showing the application of the clamping die to form the first portion of the hem fold, followed by the forward projection of a folding plate, to complete the hem fold.
Figure 5:
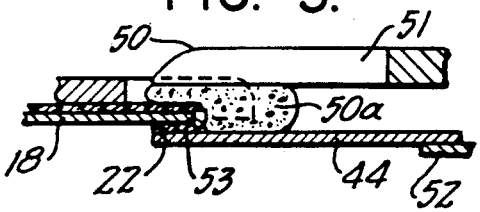

After the first partial fold of the ply, illustrated in FIG. 4 of the drawing, the transfer slide 42 is advanced, with the transfer clamp 45 in an open position. The first folding plate 44 slides closely underneath the forward extremities of the shutter plate 18, as shown in FIG. 5, causing the hem-folding margin 22 to be positively folded underneath the shutter plate 18, thus completing the hem-folding operation. Advantageously, the under surfaces of the several projections 50 of the transfer clamp are provided with soft spongy pads 51. When the transfer slide has been moved into its forwardly projected limit position, the transfer clamp is actuated in a closing direction, causing the spongy pads 51 to conform about the hem fold and provide resilient clamping engagement therewith.

Mounted on the transfer slide 42, directly underneath the first folding plate 44 is a second folding plate 52, which is projectable and retractable in the direction of the slide axis independently of the first folding plate 44. Desirably, at about the time the transfer clamp 45 is actuated to grip the hem fold designated by the reference numeral 53, the second folding plate 52 is projected forward to a predetermined limit position, illustrated in FIG. 6. In that position, the forward edge extremity 54 of the second folding plate, which extends straight across the plate (i.e., not in a V-shaped configuration), forms a folding edge 55 for the top flap 56 of the pocket ply.

Figure 6:
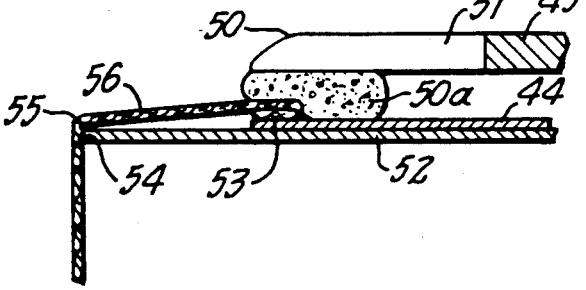
FIG. 6 is a further sequential view, illustrating the apparatus after retraction of the clamping die and the forward projection of a second folding plate to define the location of the top fold of a pocket ply.

Immediately after projection of the second folding plate 52 into its forward limit position shown in FIG. 6, the clamping die 29 is opened, releasing its grip upon the fabric ply 17 (which nevertheless remains in the grip of the now-closed transfer clamp 45). Following this, the shutter plate 18 is retracted, withdrawing its forward edge margin from within the hem fold 53. The hem fold remains in the grip of the transfer clamp 45 and the folding plate 44 and collapses to the form shown in FIG. 6, with the two layers of the fabric in direct contact with each other. As the shutter plate is withdrawn, the unsupported end of the limp ply falls by gravity, partially forming the top fold 55 about the edge of the second folding plate 54. The shutter plate returns to its load position, to receive a new ply of fabric, while further operations are to take place on the ply just released from the clamping die.

Figure 7:
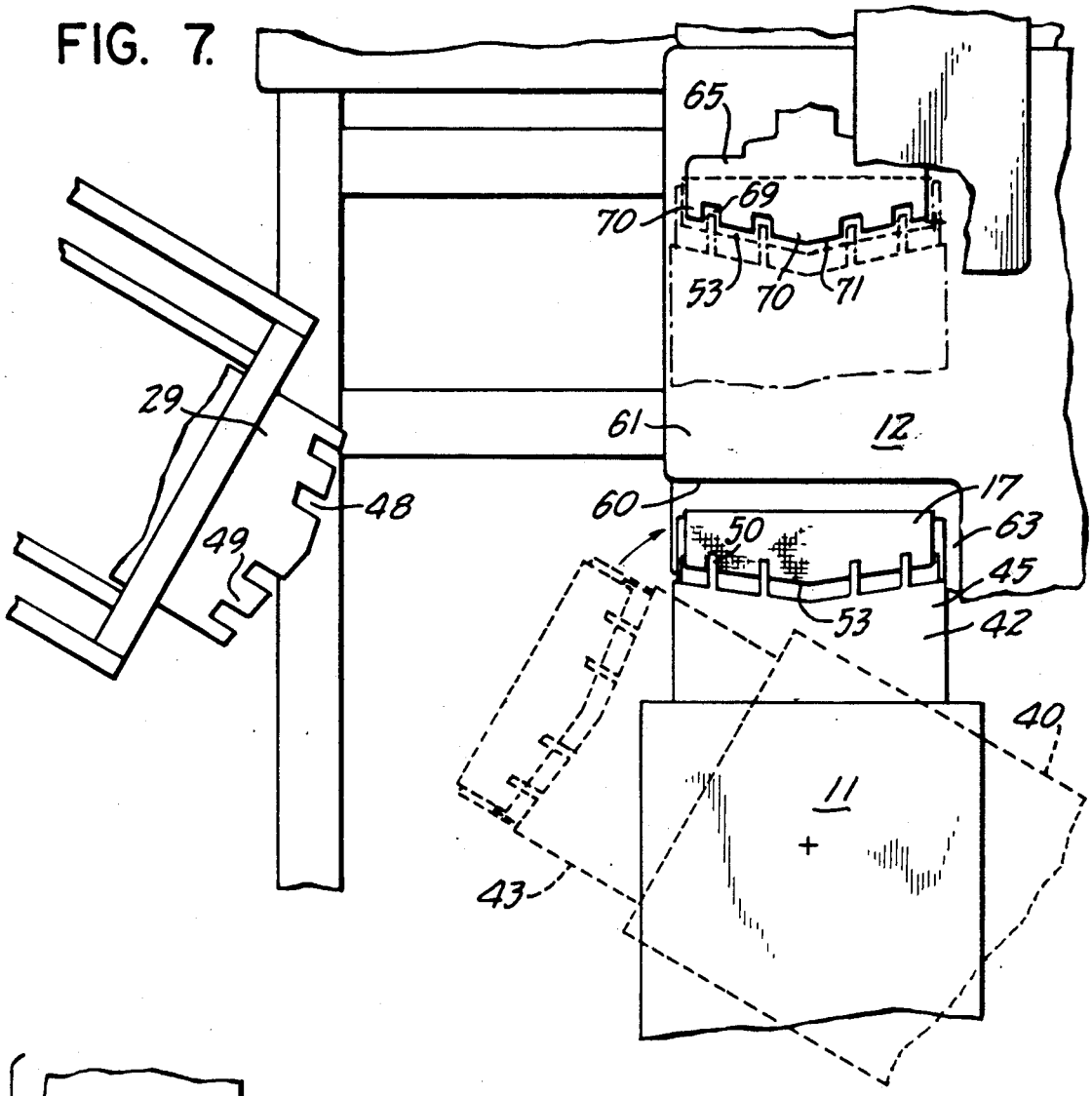
FIG. 7 is a fragmentary top plan view of the apparatus, after gripping of the hem-folded ply by transfer of clamp means and delivery thereof to a position in front of the sewing station.

With the hem-folded fabric ply now clamped exclusively by the transfer clamp 45 and first folding plate 44, the transfer slide 42 is retracted, and the base 40 is rotated about its axis 41, bringing the hem-folded ply into position in front of the sewing station 12 (see FIG. 7).

Figure 8:
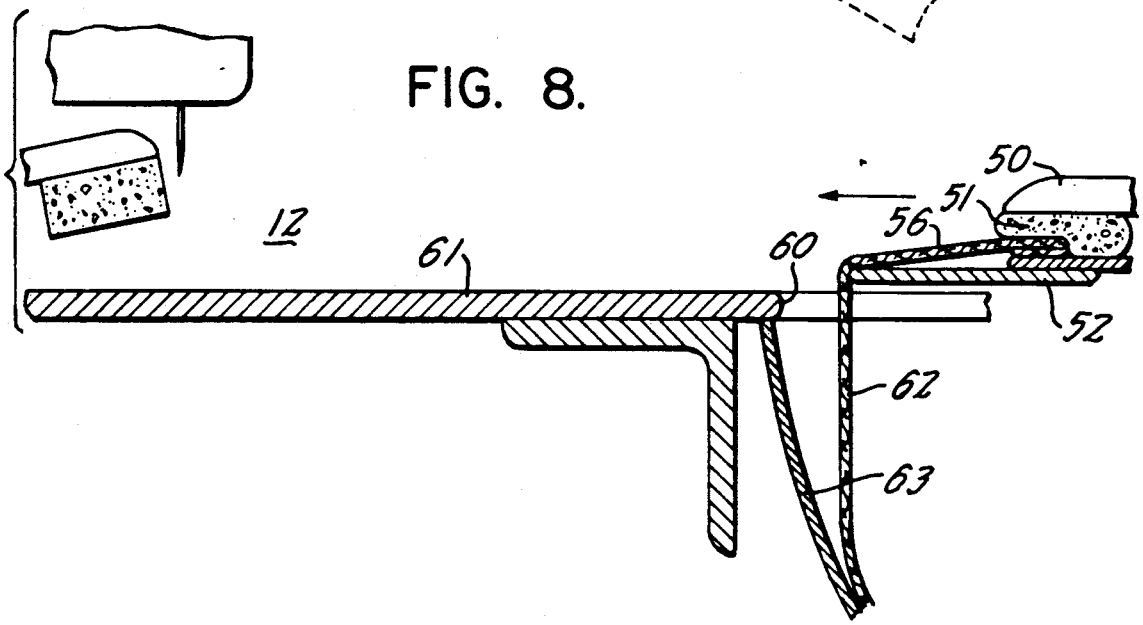
FIG. 8 is a fragmentary cross sectional view showing the apparatus positioned in front of the sewing table, holding the partially folded ply.

After pivoting of the transfer base 40 to a position confronting the sewing station 12, the retracted slide 42 is positioned such that the partially folded ply 17 is directly in front of and slightly spaced from the front edge 60 of a sewing table 61 forming part of the sewing station. The body portion 62 of the pocket ply hangs down by gravity in front of the projected folding plate 52, as shown in FIG. 8. From this position, the transfer slide 42 is actuated forwardly, carrying the folding plate 52 closely over the top surface of the sewing table 61 in a manner shown in FIG. 9 of the drawing. A transition plate or apron 63, positioned under the forward edge 60 of the sewing table, helps to confine and control the pendant flap 62 of the pocket ply during this operation.

When the transfer slide reaches the forward limit of its projected position, at the sewing station, the top fold 55 of the pocket ply has been completed, and the body portion 62 of the ply now lies flat on the sewing table, confined underneath the folding plates 44, 52. A sewing clamp 65, mounted at 66 to a programmably movable table 67 (movable according to a predetermined sewing program along X - Y coordinates) is actuated to a position contacting the top flap 56 and hem fold 53 of the pocket ply. A suitable fluid cylinder or the like, partially indicated at 68 in FIG. 1, may be utilized for actuation of the sewing clamp 65.

In the illustrated form of the invention, the configuration of the sewing clamp 65 includes a series of forwardly opening recesses 69 and intervening and adjacent projections 70 similar in location to the recesses and projections 48, 49 of the sewing clamp. The forward edge 71 of the sewing clamp is in the configuration of a shallow "V", corresponding to the V-contoured hem fold 53 of the pocket ply, as is evident in FIGS. 11, 12.

In the forwardly projected position of the transfer slide 42, the clamping projections 50 of the transfer clamp are received within the recesses 69 of the sewing clamp, enabling both the transfer clamp and the sewing clamp to simultaneously grip the fabric ply, at the folded hem. The forwardmost position of the transfer slide is controlled such that a narrow margin of the hem fold 53 is exposed beyond the forward edge 71 of the sewing clamp, providing access to that margin for sewing of the hem.

Figure 9:
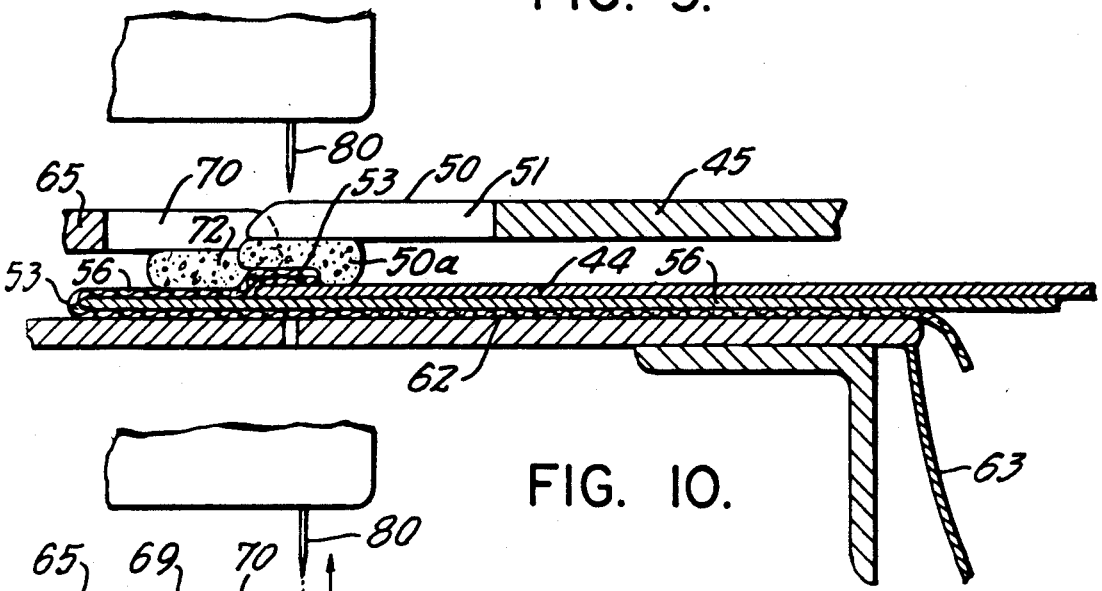
FIGS. 9 and 10 are sequential illustrations, similar to FIG. 8 showing respectively the initial placement of the fully folded pocket ply on the sewing table and the gripping thereof by a sewing clamp and, in FIG. 10, the fully folded pocket part after retraction of the folding plates.
Figure 10:
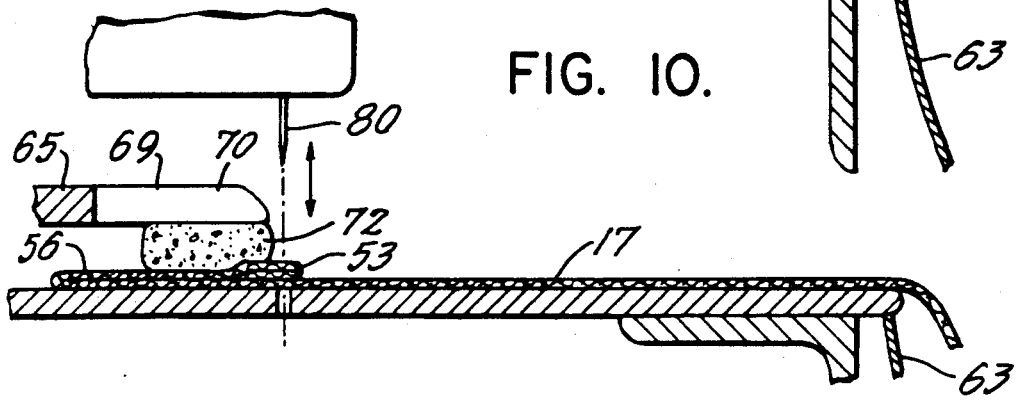

As shown in FIGS. 9 and 10, the clamping projections 70 of the sewing clamp are provided on their bottom surfaces with soft, spongy foam pads 72, arranged to resiliently press upon the folded pocket ply when the clamp is active.

As soon as the sewing clamp has engaged the folded pocket ply, the transfer clamp 45 is opened, and the folding plates 44, 52 are retracted. Advantageously, the second folding plate 52 is retractable independently of the first folding plate 44, so that the longer projection of the folding plate 52 may be fully retracted while being completely isolated from the small hem fold 53. Once the second folding plate has been retracted, the transfer slide 42 is retracted, withdrawing the first folding plate 42 from underneath the hem fold, while the hem fold remains gripped under the projections 70 of the sewing clamp 65. The transfer mechanism then returns to the loading station to receive the next ply, leaving the fully folded ply 17 supported on the sewing table 62, wi&:h a small margin of the hem fold 53 exposed, as shown in FIG. 10.

The sewing operation proceeds according to a preprogrammed (e.g., cam controlled) X - Y program, which can be one of many types well-known in the art. The sewing clamp 65 is manipulated according to the program to move the clamp (and with it the folded ply) over the surface of the sewing table 62, so that the exposed margin of the hem is advanced under the sewing needle 80, causing a line of stitching 81 (FIG. 12) to be formed, securing the hem fold 53 and the top flap 56 in the desired manner, readying the pocket ply for subsequent assembly with a shirt front.

Figure 11:
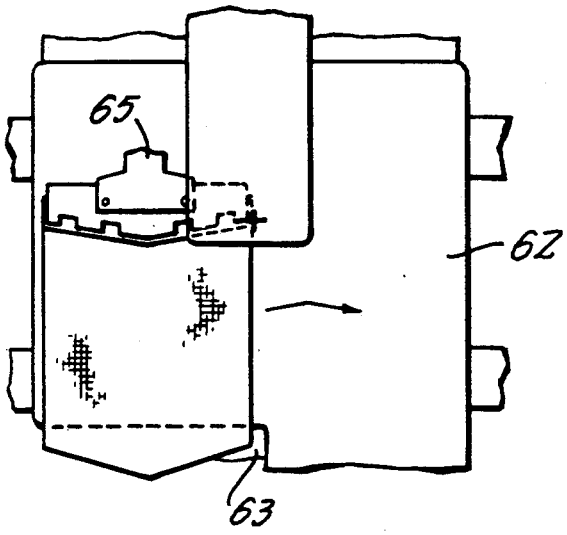
FIGS. 11 and 12 are representative illustrations showing the manipulation of the sewing clamp and folded pocket ply, after delivery to the sewing table.
Figure 12:
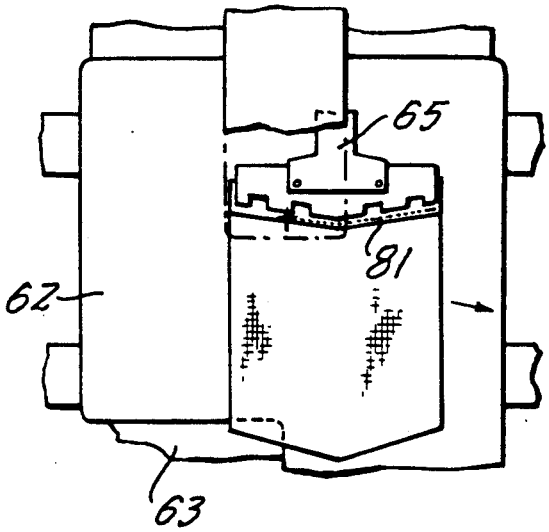

As reflected in FIGS. 11 and 12 of the drawing, as the hem stitching progresses from the right side of the pocket part to the left, the sewing clamp 65 is moved from left to right across the surface of the sewing table 62. When the sewing operation is completed, the processed pocket ply is deposited at the right side of the sewing table for removal by suitable conveyor means (not shown).

The method and apparatus of the invention enables the production of V-flap pocket plies and the like to be carried out on a fully automated basis, at a significantly lower cost then has been possible heretofore. Pursuant to prior practices, the fully automated production of pre-processed pocket plies has generally required the top flap of the ply to be a straight-across configuration, which is significantly less attractive, from a style standpoint, than the V-shaped or otherwise contoured flap.

Pursuant to the invention, the formation a contoured, hemmed flap is made possible by the use of a clamping die at the beginning of the process, which forcibly conforms an overhanging margin of the pocket ply to a contoured edge of a plate-like member on which the ply is supported. This is followed by the projection, directly underneath the plate-like member, of a folding plate which completes the formation of a contoured hem fold. By means of a series of interfitting clamps, the prefolded part is transferred to a sewing station, where a final clamp, referred to herein as the sewing clamp, is driven through a programmed path as the prefolded hem and top flap are stitched in the desired contour.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. A method of forming and sewing a fabric ply to form a contoured, hemmed flap, which comprises the steps of, (a) providing a supply of the plies, (b) depositing a single ply on an upwardly facing surface of a first plate-like member provided with a contoured end edge, (c) controllably positioning said ply on said plate-like member whereby a hem-forming margin of said ply overhangs the contoured edge of said plate-like member, (d) forming a contoured hem fold by causing same hem-forming margin to be folded around the end edge of and under said first plate-like member, (e) gripping said hem fold above and below said first plate-like member and withdrawing said first plate-like member from said hem fold, (f) providing a folding edge spaced from said hem fold, and folding the ply about said folding edge to form a top flap, (g) causing the lower portion of said ply to be folded underneath said top flap and hem fold, (h) positioning the folded ply on a sewing table and clamping the top flap which is folded and said hem fold thereon while exposing an edge portion of said hem fold, and (i) controllably stitching said hem along an exposed edge portion thereof.

2. The method of claim 1, further including the steps of (a) using said first plate-like member for loading of individual plies by causing said plate-like member to be moved between a first position, in which it receives said ply from said supply thereof and a second position at which said hem fold may be formed and gripped.

3. The method of claim 1, further including the steps of (a) forcibly conforming said hem-forming margin to the end edge of said first plate-like member, and (b) thereafter causing the margin to be folded under the bottom of said first plate-like member by moving second plate-like means into underlapping relation with said first plate-like member.

4. The method of claim 3, further in which (a) a top folding edge is formed by folding a portion of said ply around said second plate-like means.

5. The method of claim 2, in which (a) when said first plate-like member receives said ply from the supply thereof said ply is initially positioned on said first plate-like member to provide an excess hem-forming margin, and (b) thereafter said ply is controllably positioned on said first plate-like member by controllably retaining said ply while advancing said first plate-like member.

6. Apparatus for forming and sewing a fabric ply, having a body portion and a flap portion, to form a hemmed, contoured flap, which comprises, (a) a first plate-like member provided with a contoured end edge, (b) means for controllably positioning said ply on said plate-like member whereby a hem-forming margin of said ply overhangs said contoured edge, (c) clamping die means movable into cooperating relation with said plate-like member for conforming a portion of said hem-forming margin to the contoured edge thereof, (d) folding plate means movable toward and into underlapping relation to said contoured edge to fold under a free hem-forming margin of said ply for forming a hem fold, (e) transfer clamp means movable into contact with the ply positioned on said first plate-like member to cause the hem fold to be gripped above and below said plate-like member, (f) transfer means for retracting said plate-like member from the hem fold, leaving said fold clamped between said transfer clamp means and said folding plate means, (g) said folding plate means defining a top folding edge, spaced from said hem fold, for defining a top fold of said ply, (h) means for moving said transfer clamp and said folding plate means, with said hem fold clamped therebetween, to a sewing table and positioning said ply on said sewing table for sewing, (i) means associated with said folding plate means for folding the body portion of said ply about said top folding edge and under said folding plate means, and (j) means for guiding said ply for movement on said sewing table, whereby said hemmed, contoured flap is sewn to the body of said ply.

7. Apparatus according to claim 6, in which (a) said first plate-like member comprises a shutter plate, and (b) means are provided for moving said shutter plate between a loading position, adjacent a supply of plies, and a hem-forming position, remote from said supply.

8. Apparatus according to claim 6, in which (a) said clamping die means includes portions overlying an upper surface of said plate-like member and portions overlying and conforming to the contoured end edge of said member, (b) said die means includes a plurality of forwardly opening slots and intervening projections, (c) said transfer clamp means includes a plurality of complementary projections and intervening slots, aligned with the slots and projections of said clamping die means and adapted, when actuated, to clamping engage with said folding plate means a folded hem portion of the ply, whereby a hem-folded ply is gripped by said transfer clamp means before being released by said clamping die means.

9. Apparatus according to claim 6, in which (a) said means for guiding a folded ply for sewing comprises said sewing table and sewing clamp means engageable with said folded ply and movable over a surface of said sewing table with said folded ply, and (b) said sewing clamp includes a plurality of slots and intervening projections complementary to projections and slots of said transfer clamp, whereby said folded ply is engaged by said sewing clamp prior to being released by said transfer clamp.

10. Apparatus according to claim 6, in which (a) said folding plate means comprises first and second folding plates arranged in closely spaced, parallel relation, (b) said first folding plate being movable from a position in front of said plate-like member to a position underlapped with said plate-like member, to effect under-folding of the hem, and (c) said second folding plate directly underlies said first folding plate and is movable from a position in front of said plate-like member to a position underlapped therewith and projected beyond said first folding plate to a position to define the top fold of the ply.

11. Apparatus according to claim 10, further characterized by (a) actuating means associated with said first and second folding plates for first retracting said second folding plate and then retracting said first folding plate.

12. Apparatus according to claim 11, further characterized by (a) said transfer means including control means for first moving said transfer clamp and said folding plates into contacting, overlying relation to said sewing table and then effecting sequential retraction of said second and said first folding plates.

13. Apparatus for forming and sewing a fabric ply, to form a hemmed, contoured flap, which comprises (a) a plate-like member formed with a contoured end edge, (b) means for positioning the ply on said plate-like member with a hem-forming end margin of the ply projected a predetermined distance beyond said contoured end edge, (c) die means for positively conforming a projection of said hem-forming end margin to the contoured end edge of said plate-like member, (d) folding means for folding the hem-forming margin underneath said plate-like member to form a folded ply having a folded hem margin, (e) transfer means, including said folding means, for transferring the folded ply to a sewing position, (f) means defining a folding edge spaced from the folded hem margin for forming a top fold of said ply, (g) means for folding said ply about said folding edge and underneath a hem fold, (h) said transfer means including means for positioning the folded ply on a sewing table for sewing, and (i) means for manipulating said folded ply on said sewing table to enable a hem and the contoured flap defined thereby to be sewn to an underlying flap of said ply.

14. Apparatus according to claim 13, in which (a) said folding means includes first and second retractable folding plates, (b) one of said folding plates being projectable under said plate-like member for folding and holding said hem fold, and (c) the other of said folding plates being projectable under said first folding plate and defining said folding edge for forming the top fold.

15. Apparatus according to claim 14, in which (a) said second folding plate is movable to a position partially underlapping said ply whereby said ply is partially folded about said second folding plate by the action of gravity, and (b) said transfer means being movable to manipulate said second folding plate, and the ply partially folded thereabout, to complete the top fold of said ply by causing said ply to be folded underneath said second folding plate.

16. Apparatus according to claim 15, including (a) means for moving said transfer means over said sewing table, to cause said ply to be folded underneath said second folding plate.

17. An apparatus for forming and moving a hem-folded fabric, ply having a contoured edge which comprises, (a) a plate-like member for supporting the ply, (b) means for positioning the ply on said plate-like member to cause a predetermined hem-forming end margin to project beyond one edge of said plate-like member, (c) said plate-like member having a contoured end edge complementary to the contoured edge of said fabric ply, (d) means for causing a portion of said hem-forming margin to be positively conformed to a contoured end edge of said plate-like member, (e) folding plate means projectable under said plate-like member to cause a remaining portion of said hem-folding margin to be folded underneath said plate-like member to form a contoured hem, (f) said folding plate means including a folding edge, spaced from said contoured end edge, about which a portion of said ply is folded.

(g) transfer clamp means cooperating with said folding plate means for gripping said hem fold, and (h) means for separating said plate-like member and said transfer clamp.

18. Apparatus according to claim 17, in which (a) said folding plate means partly underlies said ply whereby, upon separation of said plate-like member and said clamp, portions of said ply not supported by underlying portions of said folding plate means are caused to be partially folded by gravity about said folding edge.

19. Apparatus according to claim 17, in which (a) said means for causing said hem-forming margin to be conformed to the edge of said plate-like member comprises a clamping die, (b) a first portion of said clamping die serving to clamp said ply to a top surface of said plate-like member, and (c) a second portion of said clamping die being configured to conform to and confront the contoured end edge of said plate-like member.

20. Apparatus according to claim 19, in which (a) at least the first portion of said clamping die has a plurality of front-opening recesses and intervening projections, and (b) said transfer clamp means includes a clamping member having a plurality of projections and intervening recesses complementary with the recesses and projections of said clamping die.

21. Apparatus according to claim 17, in which (a) said folding plate means includes first and second folding plates and means for independently projecting and retracting said folding plates, (b) said first folding plate serving to fold and hold said hem fold, (c) said second folding plate defining a top fold, (d) means for positioning a folded ply on a sewing table with portions of said ply between said second folding plate and said sewing table, and (e) means for sequentially retracting said second folding plate and thereafter said first folding plate.

22. Apparatus according to claim 21, including (a) sewing clamp means associated with said sewing table and formed with a plurality of front-opening recesses and intervening projections, (b) the recesses and projections of said sewing clamp being complementary to those of said transfer clamp, whereby said sewing clamp may grip a hem-folded ply before said ply is released by said transfer clamp, and (c) control means for effecting sequential retraction of said folding plates after engagement of said hem-folded ply by said sewing clamp and release thereof by said transfer clamp.

23. Apparatus according to claim 21, in which (a) said first folding plate means has a contour corresponding generally to the contours of said hem fold.

24. Apparatus according to claim 21, in which (a) said first folding plate is movable with said transfer clamp, and (b) said second folding plate being movable independently of said transfer clamp and said first folding plate.

* * * * *